United States Patent [19]

Furuike

[11] 4,455,940

[45] Jun. 26, 1984

[54] RANDOM TIME DELAY FUZE

[75] Inventor: Haruo H. Furuike, La Palma, Calif.

[73] Assignee: The United States of America as represented by the Secretary of the Army, Washington, D.C.

[21] Appl. No.: 392,495

[22] Filed: Jun. 28, 1982

[51] Int. Cl.[3] ..... F42B 13/50; F42C 5/00; F42C 15/32

[52] U.S. Cl. ..... 102/228; 102/230; 102/489

[58] Field of Search ..... 102/221-223, 102/225-230, 237, 238, 489, 393, 258

[56] References Cited

U.S. PATENT DOCUMENTS

| | | | |
|---|---|---|---|
| 3,724,385 | 4/1973 | Beatty et al. | 102/229 |
| 3,913,483 | 10/1975 | Wolterman | 102/227 X |
| 3,938,438 | 2/1976 | Anderson et al. | 102/393 |
| 3,962,974 | 6/1976 | Anderson et al. | 102/228 |
| 3,998,164 | 12/1976 | Hadfield | 102/226 |
| 4,389,940 | 6/1983 | Trembly et al. | 102/489 |

*Primary Examiner*—David H. Brown

*Attorney, Agent, or Firm*—Robert P. Gibson; Anthony T. Lane; Harold H. Card, Jr.

[57] ABSTRACT

A random time delay fuze includes a fuze base member containing a cylindrical cup guide carrying a slidably mounted cylindrical cup. The cup contains a piston which has a recess slidably mounted on a cylindrical firing pin guide which is also attached to said fuze base and contains a spring biased firing pin. The cup has a ribbon stabilizer, which when exposed to an airstream pulls the cup forward a limited distance, thereby forming a space within the cup between the piston and the cup. The piston is provided with a "floating" O-ring seal, which allows air to flow into but not out of said space, and an air restrictor, which restricts the flow of air out of said space. A biasing spring forces the piston forward in said space, causing air to be vented through the restrictor and thereby retarding the forward movement of the piston. When the piston has moved forward sufficiently, it permits locking balls to release the firing pin. The fuze base includes a detonator slider containing a detonator, which is not aligned with the firing pin in the safe position. Centrifugal force causes the detonator slider to move laterally to align the detonator with the firing pin.

14 Claims, 5 Drawing Figures

FIG. 2
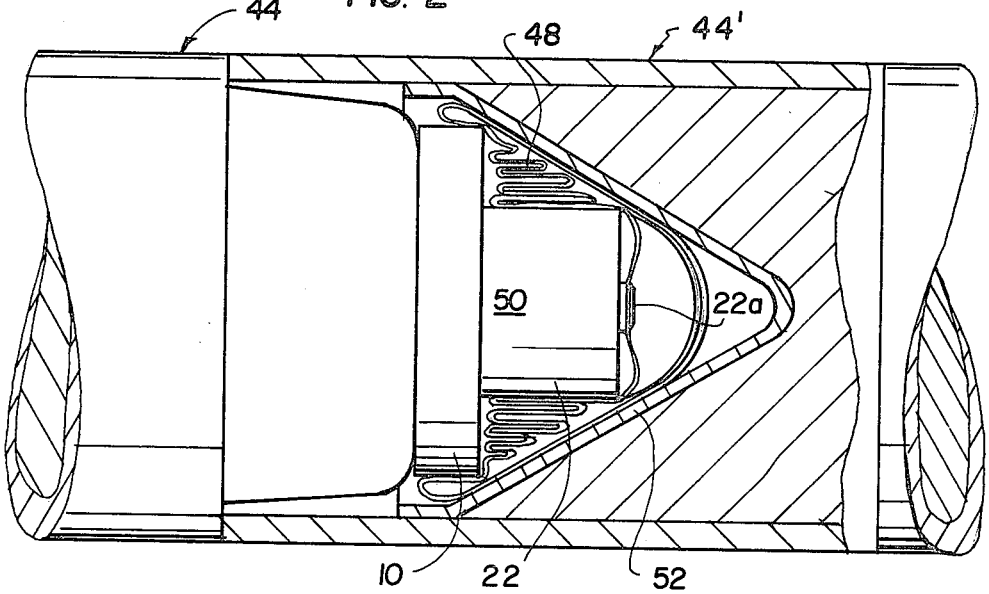
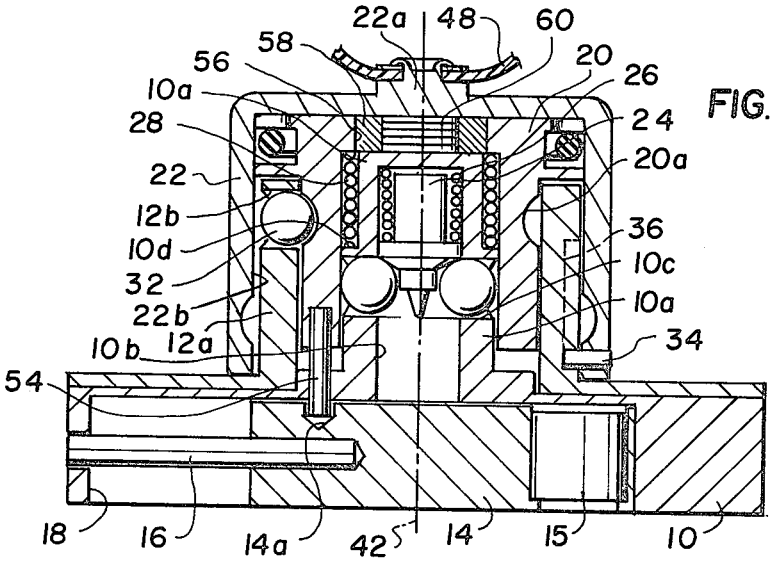
FIG. 3

RANDOM TIME DELAY FUZE

The invention described herein, was made in the course of a contract with the Government and may be manufactured, used and licensed by or for the Government for Governmental purposes without the payment to me of any royalty thereon.

FIELD AND BACKGROUND OF THE INVENTION

The present invention relates in general to fuzes for detonating explosive charges and, in particular to a new and useful random time delay fuze which utilizes a piston carrying an air restrictor passage, and slidably mounted in a cylinder, for establishing a time delay before the fuze is armed.

Various fuze designs are known for detonating explosive devices such as Grenades and the like. It is known to package a plurality of such Grenades, as submunitions, within a projectile, such as a 155 mm M483 projectile. Such submunitions include the M42 Grenade. The normal M483 cargo is 88 submunitions of this type.

SUMMARY OF THE INVENTION

The random time delay fuze according to the invention uses the principle of regulated air flow thorugh a porous medium to obtain a required delaying action. A suitable material for such porous medium is a porous polypropylene plastic film. Other possible air restrictors include sintered metal discs having one or more holes.

According to the invention, the random time delay fuze includes a cylindrical cup, a piston movable therein and having a floating O-ring seal means engaged with the cylinder cup to form a fluid volume space in the cup (filled with air in most instances), a fluid restrictor for venting fluid from the space in a restricted manner, biasing means connected to the piston for biasing the piston in a direction to reduce the volume of the space and cause the fluid in the space to move through the fluid restrictor thereby retarding movement of said piston, and fuze arming means including a detonator and a spring biased firing pin, which is released after the piston has moved through a selected distance in the cup under the influence of its biasing means.

The delay time can be adjusted by adjusting the force of the piston biasing means and/or by changing the characteristics of the air or fluid restrictor for changing the flow of fluid through the restrictor. In the case of porous plastic films, the number of films can be increased or decreased accordingly, or the nature of the films themselves may be changed to increase or decrease their permeability.

Accordingly an object of the invention is to provide a fuze which can be detonated or armed with a random or selectable time delay.

Another object of the invention is to provide a fuze which is simple in design, rugged in construction and economical to manufacture, and one which is conveniently small so as to be useful as a fuze in a submunition, which for example, is carried with many other submunitions in a single projectile.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a side elevational view with portions cut away for clarity of the inventive fuze connected to a submunition carrier, with other submunitions in a common projectile casing;

FIG. 3 is a side sectional view of the fuze according to the invention in an unarmed and initial position;

DESCRIPTION OF THE PREFERRED EMBODIMENT

Figure 1:
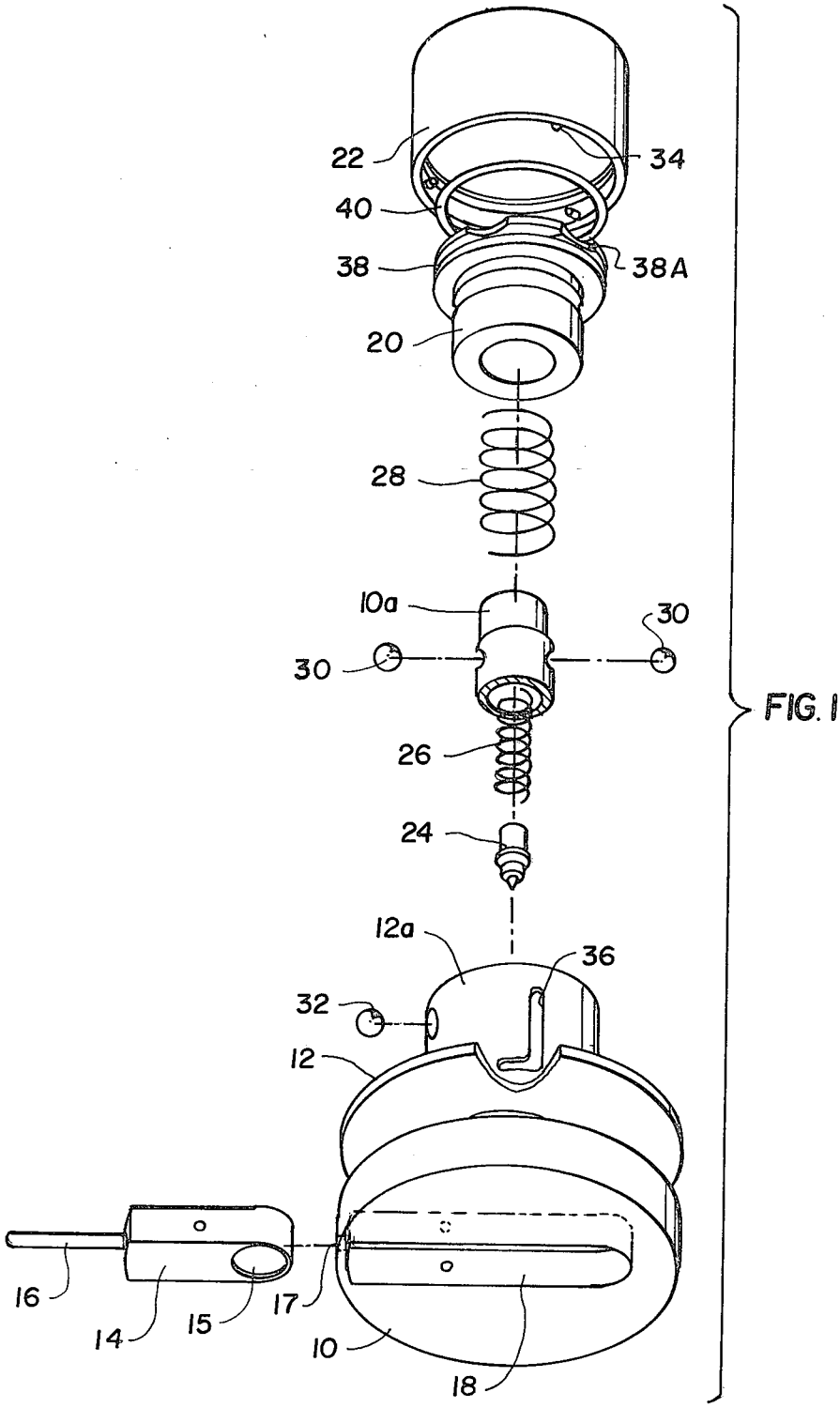
FIG. 1 is an exploded view of a fuze according to the invention which has a random time delay feature.

Turning to the drawings in particular, the invention embodied therein in FIG. 1, is a random time delay fuze which comprises a fuze base 10, a cup guide portion 12, a piston 20 and a cup 22 whose inner wall **22*b* forms a cylinder for piston 20. Cup 22 is movably mounted over a column 12*a* of the cup guide portion 12. The fuze base includes a slide track 18 which slidably receives a detonator slider 14 which carries a detonator 15. Detonator slider 14 carries a bore rider 16 which is in the form of a pin which rides within a bore 17 which extends through the base 10 and into the slide track 18**.

The fuze includes a firing pin 24, a firing pin spring 26, a piston spring 28 and locking balls 30 and 32.

Cup 22 is provided with three guide pins 34 which ride in three L-shaped grooves 36 formed in the cup guide portion column **12*a*. Piston 20 includes O-ring flanges 38 and 38A which carries a floating O-ring 40**.

Turning to FIG. 3, the fuze is shown in its initial or unarmed position. In this position slider 14 is in its right hand position with detonator 15 misaligned with essential axis 42 of the firing pin 24 and of the fuze as a whole. Slider 14 with bore rider 16 has a center of gravity which is to the left of axis 42, so that with a spinning movement of the fuze as a whole, the slider 14 will tend to move to the left, through centrifugal force, to cause detonator 15 to move into its aligned position shown, for example, in FIG. 5.

As shown in FIG. 2, the fuze 50 is mated with an explosive charge in a Grenade 44, and nested with a plurality of other Grenades, such as Grenade 44' in a tube of a projectile, not shown. The fuze, generally designated 50 includes a stabilization ribbon 48 which is connected to the top of cup 22 at a ribbon connection **22*a*. The stabilization ribbon 48 is folded for deployment around the top of fuze 50 and held in position, with the fuze 50 and the grenade 44 as a whole, by the shaped charge liner 52 of Grenade 44', for example. The shaped charge liner 52, or the projectile tube (not shown) act with the bore rider 16 to prevent movement of the slider 14**, when the fuze with its subarmament is nested within the projectile tube, as an added safety feature.

Returning now to FIG. 3, a fuze base 10 includes a column portion **10*a* which defines a firing pin cylinder 10*b*. Firing pin 24 is positioned in firing pin cylinder 10*b* and held against the bias of firing pin spring 26 by locking balls 30 which bear against a conical portion of firing pin 24 and are contained within radial bores 10*c* of column 10***a*. Column 10*a* is in turn positioned within a cylindrical space defined by piston 20. Column 10*a* also includes a flange 10*d* which bears against piston spring 28.

Piston 20 includes a slider lock pin 54 which extends into a bore 14*a* of the slider 14. With the piston in its lowermost position as shown in FIG. 3, slider 14 is thus prevented from moving, in addition, by the lock pin 54. Lock pin 54 extends through a suitably provided bore in the base 10, for this purpose.

Piston 20 is held in its lowered position by three locking balls 32 each of which is held in radial bores 12*b* of column 12*a* between an annular groove 20*a* on the outside of piston 20, and the inner wall 22*b* of cup 22. Piston 20 is also provided with a bore 56 which receives a mounting ring 58 which in turn carries an air or fluid restrictor 60, whose function and construction will be explained hereinunder.

Figure 4:
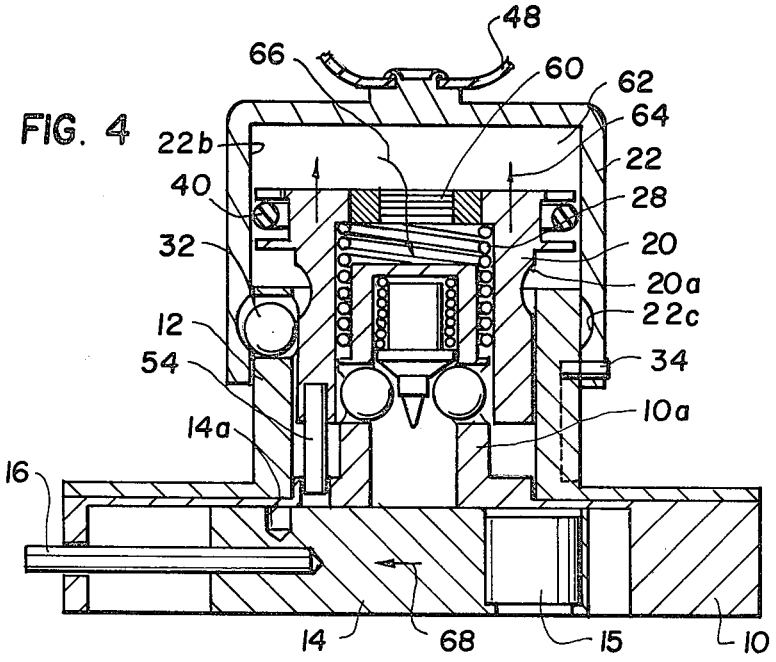
FIG. 4 is a view similar to FIG. 3 of the fuze in a semi-armed position.

Turning to FIG. 4, which shown an intermediate or semiarmed configuration of the fuze, after the grenade with fuze 50 has been deployed from its projectile tube (not shown) by means of a conventional propelling charge (not shown), the ribbon 48 is presented to the surrounding air stream. Ribbon 48 stabilizes the position of the grenade, and at the same time, the air resistance produced by ribbon 48 causes both a relative rotation between th cup 22 and base 10, and also a displacement of cup 22 upwardly. The relative rotation is established due to the spin imparted on the grenade by the spinning projectile and a resistance to such spin caused by the air resistance of stabilization ribbon 48. The relative rotation thus permits the movement of guide pins 34 from the lower leg portions of L-shaped grooves 36, into the longitudinal portions thereof.

Flange 38 of piston 20 is provided with O-ring 40 which bears against the inner wall 22*b* of cup 22. While O-ring 40 usually provides an air seal for a cylinder space 62 defined between cup 22 and piston 20, the lifting of cup 22 through the action of ribbon 48 forces the O-ring 40 to the scallopped flange 38*a* of piston 20 to defeat the air sealing function thus permitting space 62 to fill with air, so that the fuze takes on the configuration shown in FIG. 4. At the instant cup 22 is fully extended by the ribbon 48, piston 20 will rapidly move approximately 0.010 inch to bear against O-ring 40 thus providing a seal for space 62. At this moment, air in space 62 is compressed by the force of spring 28 and metered through the porous medium 60.

As soon as cup 22 rises to a level at which its inner annular groove 22*c* aligns with the locking ball 32, locking ball 32 is then released from the outer annular groove 20*a* of piston 20, which unlocks piston 20 and permits piston 20 to move upwardly, in the direction of arrows 64, due to the bias of piston spring 28. This upward movement is controlled not only by the bias of spring 28 but also by the passage of air, in the direction of arrow 66, through restrictor 60. A random or selectively variable time delay is thus established in the rate at which piston 20 rises.

For proper functioning, the floating o-ring 40 fits loosely within the flanges 38 and 38A of the piston 20, but has an interference fit of a few thousandths of an inch with the bore of the cup cavity. The floating o-ring is used as a check valve for the fuze design. When the cup 22 is being retracted by the drag ribbon under dynamic conditions, the o-ring 40 is moved up to the upper scallopped flange 38A allowing air to enter around the inside diameter of the o-ring 40 and pass through the vented flange 38A into space 62. After the arming sequence is completed, the piston 20 begins to move into the firing mode under the force of piston spring 28. As the piston moves, the o-ring comes in contact with the lower flange 38 of the piston, which then acquires a seal.

During the time period shown in FIG. 4, centrifugal force also acts on slider 42 to cause it to move to the left as shown by arrow 68. Such movement is also permitted due to the disengagement of lock pin 54 from bore 14*a* of slider 14.

Figure 5:
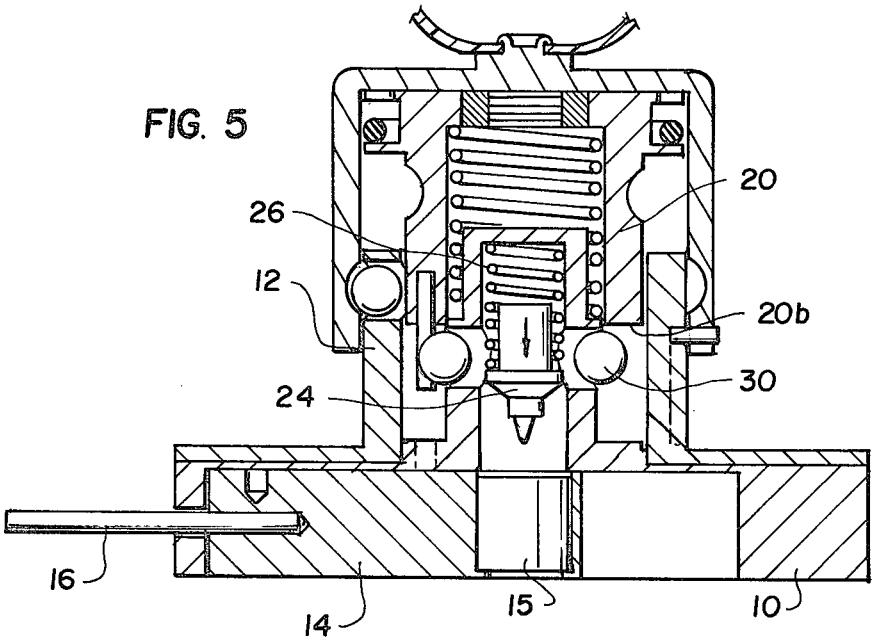
FIG. 5 is a view similar to FIG. 3 of the fuze in its fully armed position.

FIG. 5 shows a fully armed configuration of the fuze. The cross-sectional view is taken at a slightly rotated position as compared to FIGS. 3 and 4 so as to illustrate the movement of firing pin locking balls 30.

After the aforementioned time delay, piston 20 will be in its fully up position shown in FIG. 5. In this position, the bottom edge 20*b* of piston 20 will pass locking balls 30. To the combined action of centrifugal force and also the inclined surfaces of firing pin 24 which bears against balls 30, balls 30 will be forced outwardly to release firing pin 24. At this point firing pin 24 moves downwardly under the influence of its firing pin spring 26. Spring 26 can be selected either to have sufficient force to cause firing pin 24 to stroke detonator 15 and detonate it, or merely to move firing pin 24 beyond locking balls 30, whereby firing pin 24 strikes deonator 15 with sufficient force only after impact.

According to a preferred form of the invention, restrictor 60 is made of porous polypropylene plastic. Ten layers of 0.001 in. thick plastic film is utilized as the restrictor and mounted in restrictor ring 58 for positioning on piston 20.

The plastic material used in one form of the invention is known as Celgard 2402 ® which is a trademark of the Celanese Corp. for isotactic homopolymer polypropylene film. The properties and microporosity of the film is given in the following table.

Properties of Microporous Polypropylene Film

| Property | Measurement | Unit | ASTM Test Method |
|---|---|---|---|
| Porosity | 38 | & | D-2873 |
| Nominal thickness | 1 | mil | |
| Area Factor | 50,000 | sq.in./lb | |
| Effective pore size | 0.02 | μm | |
| Critical surface tension | 35 | dynes/cm | D-2573 |
| Ultimate tensile strength | | | |
| MD | 20,000 | psi | D-882 |
| TD | 2,000 | psi | D-881 |
| Ultimate elongation | | | |
| MD | 50 | % | D-882 |
| TD | >250 | % | D-882 |
| Heat-seal range | 300 to 350 | °F. | |
| Shrinkage MD understrained | <5 | % | D-1204, 60 min, 90° C. |

The time delay of fuze arming can be varied by varying the number of laminations of the plastic film, by changing the plastic film to plastic film of different porosities , and also by varying the force of piston spring 28.

In FIG. 5, the slider 14 has moved to its fully armed position with detonator 15 in alignment with firing pin 24 and with bore rider 16 in its fully extended position. Bore rider 16 also acts an an arming indicator. With bore rider 16 extended as shown, it is assumed that the fuze is in its armed position.

While a specific embodiment of the invention has been shown and described in detail to illustrate the application of the principles of the invention, it will be understood that the invention may be embodied otherwise without departing from such principles.

I claim:

1. A time delay fuze comprising:

a cylindrical firing pin guide having an open end;

a detonator slider including a detonator mounted adjacent to said open end of said firing pin guide;

a firing pin slidably mounted in the open end of said guide for firing said detonator;

spring means urging said firing pin toward said detonator;

means for releasably locking said firing pin to said firing pin guide;

a cylindrical cup guide means concentric with said cylindrical firing pin guide;

a cylindrical cup slidably mounted on said cup guide;

means for limiting travel of said cup on said cup guide;

a piston having an inner recess slidably mounted between said firing pin guide and said cup guide, said piston being movable in said cup to form a fluid volume space in said cup and having means for forming a unidirectional seal between the perimeter thereof and the inner wall of said cup, said seal permitting passage of fluid therethrough into said space but not in the reverse direction;

means for releasably locking said piston to said cup guide;

means defining a fluid restrictor for venting fluid from said space in a restricted manner;

biasing means connected to said piston for moving said piston to reduce the volume of said space and cause fluid in said space to move through said fluid restrictor and thereby retard movement of said piston;

whereby movement of said piston to a selected position in said cup releases said firing pin locking means.

2. A time delay fuze according to claim 1, further including a cup deployment means for extending said cup with respect to said cup guide and from said piston to form said fluid volume space.

3. A time delay fuze according to claim 2, wherein said deployment means comprises a stabilization ribbon connected to said cup extending said cup from said base when said stabilization ribbon is exposed to an air stream.

4. A time delay fuze according to claim 2, wherein said piston biasing means comprises a piston spring positioned between said firing pin guide and said piston.

5. A time delay fuze according to claim 2 wherein said firing pin releaseable locking means comprises at least one radial bore in said firing pin guide and a firing pin locking ball in said bore, said ball being retained in said bore and against at least a portion of said firing pin by said piston in its lowered position and movable out of said bore with said piston in a raised position to release said firing pin.

6. A time delay fuze according to claim 2, wherein said means for forming a unidirectional seal between said piston perimeter and said cup wall includes an upper scalloped flange and a lower unscalloped flange on said piston and a ring seal loosely disposed between said upper and lower flanges, whereby extension of said cup from said piston to form said fluid volume space moves said ring seal against said scalloped flange to permit passage to fluid into said space and forward movement of said piston in said cup to reduce said space forces said ring seal against said unscalloped flange and cup wall to prevent passage of fluid therethrough.

7. A time delay fuze according to claim 2, wherein said means for limiting travel of said cup on said cup guide includes at least one L-shaped guide groove in said cylindrical cup guide, and said cup includes at least one guide pin extending into said guide groove, said pin releasably locking said cup to said cup guide when positioned in the lower leg of said L-shaped guide and limiting the relative movement between said cup and said cup guide when moved into the longitudinal leg of said groove by rotation of said cup relative to said cup guide.

8. A time delay fuze according to claim 7, wherein said releasable piston locking means includes a radially extending bore in said cup guide, an outer annular groove in said piston aligned with said bore with said piston in a lowered position, and a locking ball in said cup guide bore and engaged with said piston groove, said ball being held in said bore by said cup, said cup containing an inner annular groove for receiving said ball to release said piston when said cup groove is aligned with said ball.

9. A time delay fuze according to claim 2, wherein said fuze comprises a base including a guide track, said detonator slider being positioned in said guide track initially with said detonator in a position away from a central axis of said fuze, a center of mass of said detonator slider being positioned on a side of said axis away from said detonator whereby spin of said fuze about its axis causes movement of said slider into a position with said detonator axially aligned with said fuze axis.

10. A time delay fuze according to claim 9, including a bore rider extending from said detonator slider and extending through a bore in said fuze base communicating with said slider track.

11. A time delay fuze according to claim 9, including a locking pin extending from said piston, a bore extending through said base and communicating with said slider track aligned with said locking pin and a slider bore in said detonator slider for receiving said pin with said piston in its lowered position and said detonator slide in its initial position, for locking said detonator slide from movement.

12. A time delay fuze according to claim 2, wherein said means defining a fluid restrictor comprises an opening in said piston communicating with said fluid volume space and a porous member extending across said opening.

13. A time delay fuze according to claim 12, wherein said porous member comprises at least one layer of porous plastic film.

14. A time delay fuze according to claim 13, wherein said porous plastic film comprises polypropylene film, said porous member comprising a plurality of layers of polypropylene film.

* * * * *